United States Patent [19]

Gaudiano

[11] 3,957,045

[45] May 18, 1976

[54] UNDERWATER BREATHING METHOD AND APPARATUS

[75] Inventor: Anthony V. Gaudiano, Metairie, La.

[73] Assignee: Taylor Diving & Salvage Co., Inc., Belle Chasse, La.

[22] Filed: Dec. 6, 1974

[21] Appl. No.: 530,386

[52] U.S. Cl. ..... 128/142.3; 128/274; 137/599.2

[51] Int. Cl.[2] ..... A62B 7/00

[58] Field of Search ..... 128/142.3, 142.2, 142, 128/145.8, 145.5, 274, 211; 137/599.2, 513.7, 525

[56] References Cited

UNITED STATES PATENTS

| | | | |
|---|---|---|---|
| 1,952,430 | 3/1934 | Glab | 137/599.2 |
| 2,854,001 | 9/1958 | Humblet | 128/142.2 |
| 2,861,569 | 11/1958 | Emerson | 128/142.2 |
| 3,032,063 | 5/1962 | Wells | 137/599.2 |
| 3,572,375 | 3/1971 | Rosenberg | 128/274 |

*Primary Examiner*—Robert W. Michell
*Assistant Examiner*—Henry J. Recla
*Attorney, Agent, or Firm*—James E. Cockfield

[57] ABSTRACT

An underwater breathing method and apparatus wherein a supply valve is connected to a diver's helmet and includes a valve body having a central bore for delivering a breathable gas from a supply conduit into the diver's helmet. The central bore is internally fashioned with an annular valve seat which cooperates with a compatible portion of the valve member to regulate a flow of gas through the valve body. A wall means defining a bore extends through the valve member with a first end in communication with an inlet portion of the supply valve and a second end in communication with an outlet portion of the supply valve for permitting gas to pass internally through the valve member.

2 Claims, 4 Drawing Figures

UNDERWATER BREATHING METHOD AND APPARATUS

BACKGROUND OF INVENTION

The present invention relates to underwater breathing methods and apparatus. More particularly the invention pertains to a safety supply valve method and apparatus for an underwater breathing system.

Although references may be found to "divers" as early in history as Homer's "Illiad" commercial diving activity, in significant part, was only recently ushered into existence through exigencies connected with offshore petroleum exploration and production.

In the offshore commercial diving industry safety is a paramount concern. In this regard the diving community is continually striving to develop equipment and operating procedures which will enhance diver safety. The subject method and apparatus invention is believed to be a notable step in this direction.

As previously mentioned, commercial diving activity was manifoldly expanded with the emergence of offshore oil and gas exploration and production in the fifties. In this connection divers are needed in the offshore oil industry for inspection tasks, making submerged connections, etc.

As the world's rate of demand for petroleum caught and then exceeded the rate of discovering land based oil supplies, it became economical to extend exploration and production activity into offshore regions. As an example, significant exploration, drilling and production activity presently exists in the North Sea which has an average depth of three to four hundred feet. At such depths considerable attention has been given to utilize gas mixtures which are compounded to minimize interference with normal absorption of oxygen by the bloodstream. Notwithstanding, however, use of sophisticated gas mixtures, at least some instances have occurred wherein a submerged diver has become confused or disoriented due to a lack of oxygen supply to the brain. To accommodate anomalous instances conventional diving helmets are typically fitted with a variable flow supply valve which is subject to diver control. In this regard if a diver occasions a sense of exhaustion, muscle fatigue, etc. all that is normally required is for a diver to open the supply valve in order to increase gas flow rates and thus oxygen to his system.

In at least some instances, however, it is possible that a diver may become disoriented due to oxygen starvation and actually turn down or close off the supply valve erroneously thinking that gas flow was being increased. It will readily be realized that such an occurrence would exponentially compound a diver's oxygen deficiency situation leading to possible unconciousness and in some instances even death.

Accordingly, it would be highly desirable to provide an underwater breathing system supply valve which would be fully operative under nominal conditions and which would also eliminate the possibility of a diver terminating his own gas flow.

Further under nominal operational circumstances it is highly unlikely that a diver's umbilical, or gas supply line, would lose pressure. Notwithstanding, however, the statistical improbability of such an occurrence it may be possible to visualize bizarre circumstances wherein a supply line may be severed or accidentally ruptured. In such circumstances it is necessary to prevent a counter flow of gas from the diver's pressurized helmet in order to preserve in the diver's helmet a gas bubble which will permit a safe return to the surface or an underwater working chamber.

Accordingly it would also be highly desirable to provide an underwater breathing system supply valve which would be fully operative under nominal conditions while eliminating the possibility of a diver erroneously terminating his own gas flow and further which would prevent a counter flow of gas from a diver's helmet in the event a supply line is accidentally ruptured.

The problems suggested in the proceeding are not intended to be exclusive but rather are among many which may tend to reduce the effectiveness of prior underwater breathing systems. Other noteworthy problems may also exist, however, those presented above should be sufficient to demonstrate that underwater breathing system supply valves appearing in the prior art have not been altogether satisfactory.

OBJECTS AND SUMMARY OF INVENTION

Objects

Accordingly it is a general object of the invention to provide a safety supply valve method and apparatus for an underwater breathing system which will obviate or minimize problems of the type previously described.

It is a particular object of the invention to provide a novel safety supply valve method and apparatus for an underwater breathing system wherein a minimum flow of gas through the valve will be maintained notwithstanding the fact that a diver may have become disoriented and closed a normal flow path through the supply valve.

It is another object of the invention to provide a novel safety supply valve method and apparatus for an underwater breathing system which will readily permit a flow of breathable gas through the interior of a closed supply valve member while preventing a counter flow of gas through the interior of the valve member during an exigence circumstance such as in the event a supply conduit is severed.

It is a further object of invention to provide a novel safety supply valve method and apparatus for an underwater breathing system wherein a highly reliable and maintainable valve assembly is internally mounted within a supply valve body to permit a flow of breathable gas through the supply valve body to a diver while preventing a counter flow of gas from a diver's helmet.

Brief Summary

A supply valve for an underwater breathing system according to a preferred embodiment of the invention, which is intended to accomplish at least some of the foregoing objects, includes a valve body having a central bore extending therethrough with an inlet and an outlet at either end of the bore. The central bore is internally fashioned adjacent the outlet end with an annular valve seat which is dimensioned in cooperation with a valve member intimately positioned within the bore. A hand knot connected to the valve member permits a diver to control the positioned of the valve member and thus selectively regulate gas flow through the valve body.

A bore extends through the valve member and is in fluid communication with the inlet and outlet of the valve body for permitting passage of gas internally through the valve member even though a diver may have manipulated the hand knob to completely close the valve member against the valve seat.

A second valve member is positioned within the bore extending through the primary valve and permits a flow of gas through a bore from the inlet to the outlet of the main valve while preventing a counter flow of gas internally through the valve from the outlet thereof to the inlet.

A method in accordance with a preferred embodiment of the invention includes the steps of regulating the flow of breathable gas around the valve member and through the central bore by selective manipulation of the hand knob and regulating the flow of gas through the valve member by permitting gas to flow through a bore of the valve member in the event a diver closes the valve against the valve seat. The method may further include the step of preventing gas from flowing through the bore in the reverse direction in the event gas pressure at the inlet drops below gas pressure at the outlet of the supply valve.

THE DRAWINGS

Further objects and advantages of the invention will become apparent from the following detailed description of a preferred embodiment of the invention taken into conjunction with the accompanying drawings wherein.

Figure 4:
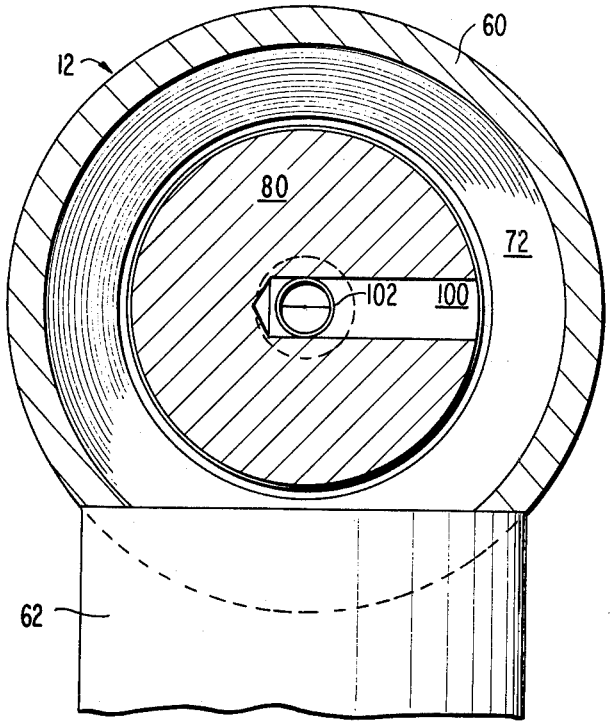
Figure 2:
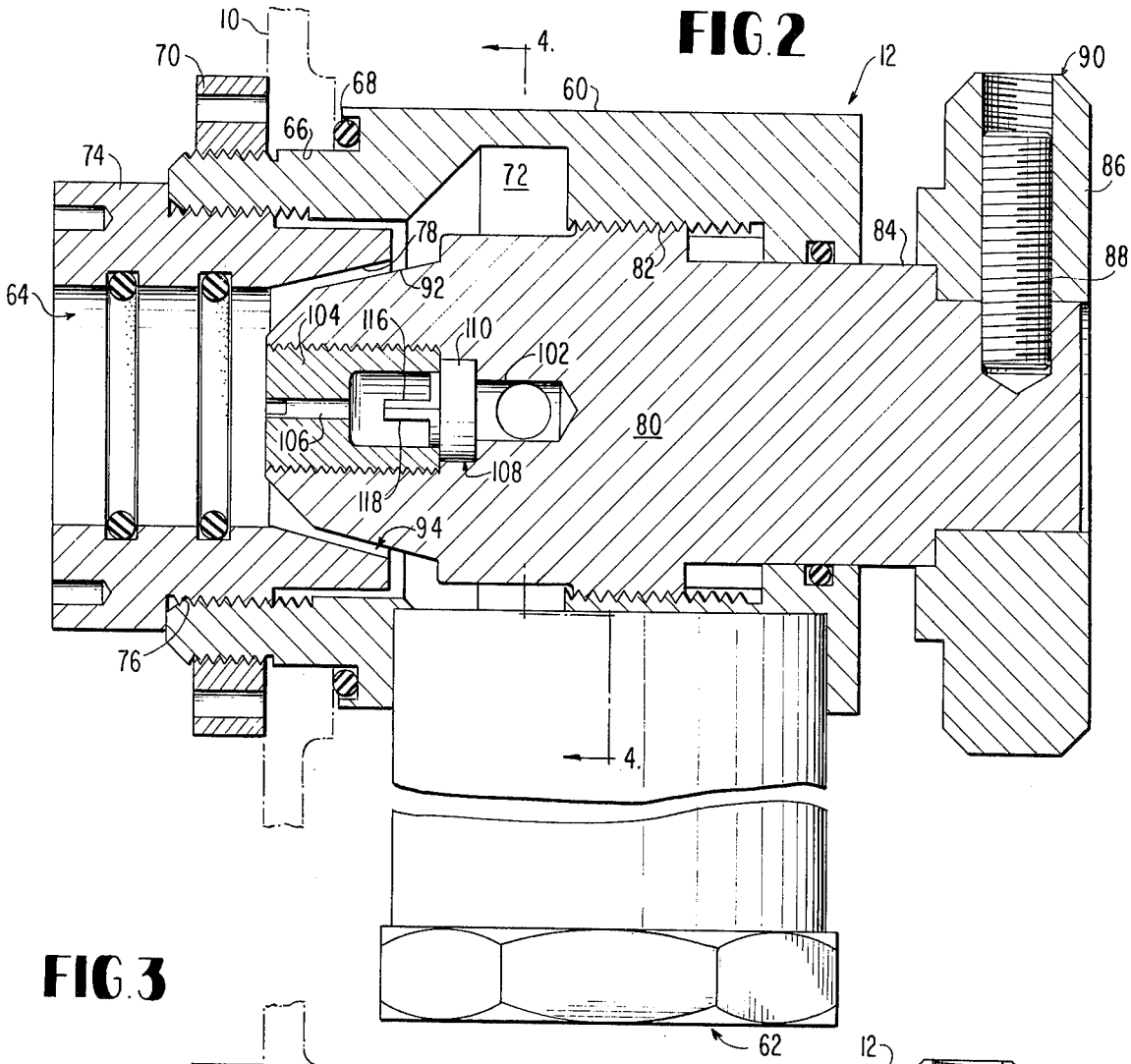
FIG. 2 is a cross-sectional detail view of a gas supply valve for an underwater breathing system according to a preferred embodiment of the present invention wherein a valve member is displaced or unseated with respect to a valve seat thus permitting breathable gas to flow through a central bore fashion through the supply valve.
Figure 3:
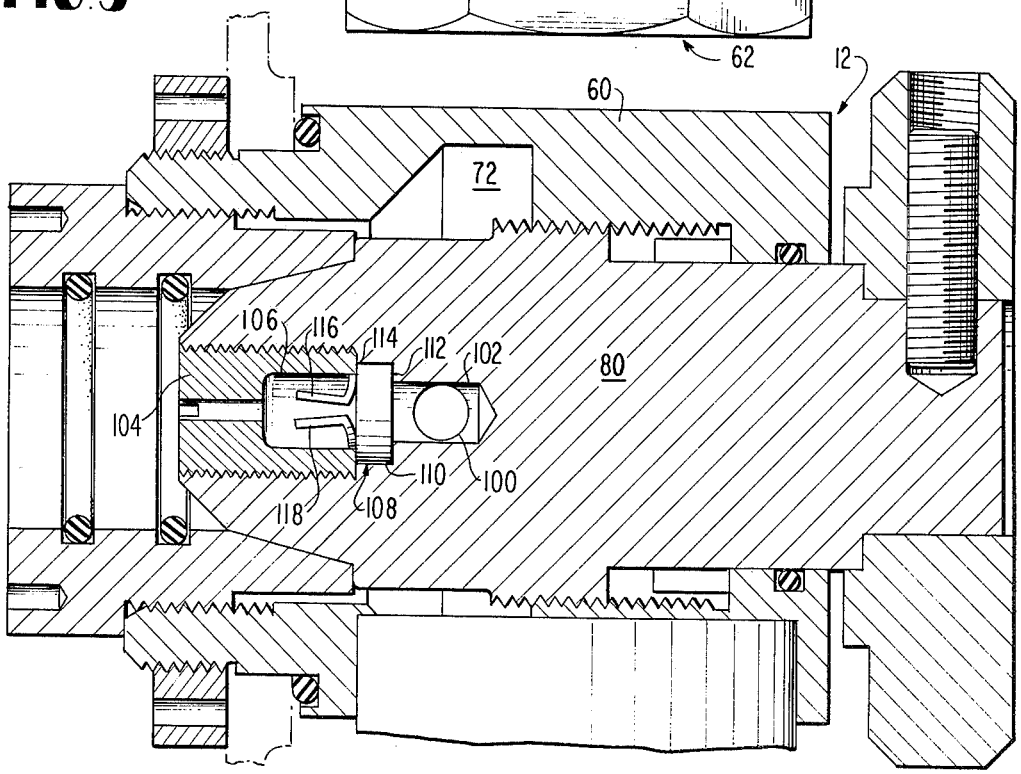

FIG. 3 is a cross-sectional detailed view similar in character to FIG. 2 wherein the valve member is turned down tightly in engagement with the valve seat and wherein a second internal valve member in an open posture thus permitting flow internally through the valve member even though the main valve is turned to a closed position; and FIG. 4 is a cross-sectional detailed view taken along section line 4—4 in FIG. 2 and discloses an internal bore fashion through the valve member.

DETAILED DESCRIPTION

Context of the Invention

Prior to discussing in detail the structure of a preferred embodiment of the subject supply valve for an underwater breathing system, it may be useful to briefly review at least one underwater breathing system where the invention finds particular utility.

Figure 1:
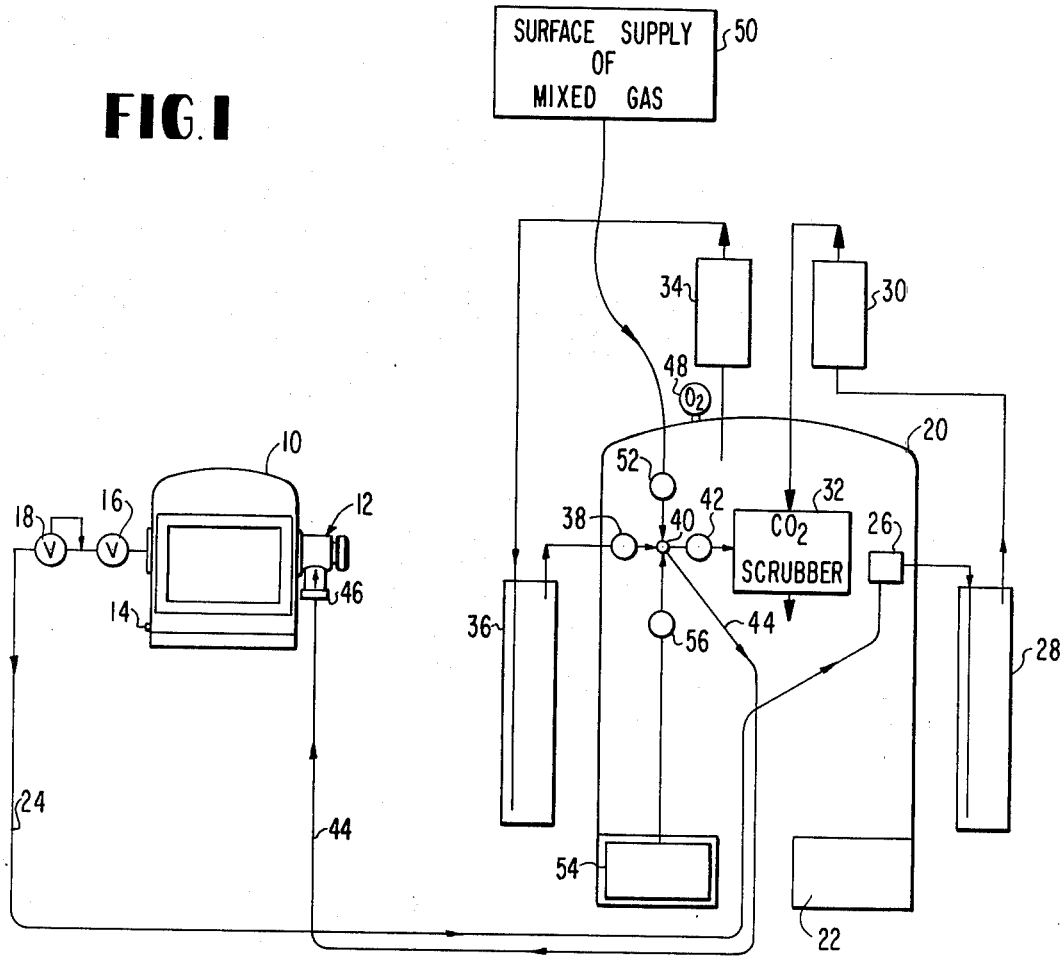
FIG. 1 is a schematic view of at least one embodiment of an underwater breathing system wherein the subject invention finds particular utility.

More particularly, and with particular reference to FIG. 1, a supply valve according to the subject invention is incorporated within a closed circuit, free flow underwater breathing system.

A detailed disclosure of a closed circuit free flow underwater breathing system may be noted by reference to U.S. Pat. No. 3,802,427 issued Apr. 9, 1974, and assigned to the assignee of the subject application. The disclosure of this patent is hereby incorporated by reference as though set forth at length.

Briefly, however, a closed circuit, free flow underwater breathing system includes a helmet 10 which is operable to be placed upon a diver's head to preserve a bubble of breathable gas about a diver's face while sweeping away exhausted carbon dioxide. Breathing gas, at a pressure greater than referenced continually flows through a supply valve 12, according to the subject invention, and into the helmet 10. Gas which is supplied to the helmet may be continuously exhausted through a combination chin-button exhaust valve 14 directly into the sea. With the system disclosed in FIG. 1, however, normally the gas flows through a safety shutoff valve 16 and the back pressure regulator valve 18. The back pressure regulator valve monitors pressure within the helmet 10 relative to ambient water pressure surrounding the helmet so as to tend to maintain a desired pressure in the helmet.

A diving or submersible decompression chamber 20 may be comprised of a type such as disclosed in U.S. Pat. No. 3,323,312 issued June 6, 1967 and assigned to the assignee of the subject application. This chamber is lowered from a service vessel to an approximate work location. As is described in the aforesaid U.S. Pat. No. 3,323,312, divers move into and out of the submerged diving chamber 20 by way of a base opening 22 which freely communicates with an ambient body of water in which the chamber 20 is submerged.

Gas flows from helmet 10 through a return conduit 24 to a return gas manifold 26 mounted within chamber 20. This manifold, which may be considered part of return conduit 24 is normally equipped with appropriate valving and a pressure indicator.

The return gas then flows into a return tank 28 which contains a mass of stainless steel, monel or copper wool to remove entrained water in the breathing gas. The tank 28 provides a reservoir of breathing gas at a pressure less than reference so that gas will readily flow from the diver's helmet 10. Gas is withdrawn from return tank 28 by a depressor pump 30 and forced through a carbon dioxide scrubber 32 into the interior of chamber 20. Gas passing through this scrubber is treated such that at least a significant reduction in carbon dioxide content is effected prior to discharge of the gas into the enclosure 20. The gas is then withdrawn from enclosure 20 by a compressor 34 which delivers pressurized gas to a supply tank 36. From the supply tank the pressurized gas passes through a control valve 38 and into a mixing manifold 40. The mixing manifold 40 is operable to selectively deliver pressurized gas through a control valve 42 back into scrubber 32 and into the interior of chamber 20. Additionally, gas is continuously delivered from the manifold 40 into a supply conduit 44 for delivery to an inlet 46 of the supply valve 12.

By the above-outlined fluid circuitry, breathable gas is continuously circulated through helmet 10 wherein carbon dioxide is swept away from the face of a diver and returned to a carbon dioxide scrubber. An inert carrier gas such as helium is continuously circulated without effect. The oxygen content of the gas, however, is continuously being withdrawn and converted to carbon dioxide by the diver. In order to replenish the oxygen supply, alternate sources are envisioned. In this connection, an oxygen tank 48 may be connected to the chamber 20 for delivery of gas directly into the interior of the chamber where the oxygen is mixed with the helium carrier prior to delivery to compressor 34. Alternatively, oxygen and/or a mixture of oxygen and helium may be delivered from a surface supply 50 through a control valve 52 and into manifold 40 for delivery into supply conduit 44 or selectively into the scrubber 32.

In the event the main oxygen supply 48 is exhausted and the surface supply 50 is unavailable, an emergency supply of oxygen and/or a breathable mixture of helium and oxygen 54 is carried by the chamber 20 and functions to selectively deliver gas through a control valve 56 to the manifold 40 for use by the system as previously described.

Having established an operative context in which the subject supply valve finds particular utility, attention is now invited to FIGS. 2 through 4 wherein the supply valve 12 according to a preferred embodiment of the invention is disclosed.

Supply Valve Structure

The supply valve 12 is compressed of a main body portion 60 having an inlet and as at 62 and an outlet as at 64. The outlet end of the valve body 60 is intimately received through an aperture 66 fashioned within a sidewall of the helmet 10. A peripheral seal 68 is fitted within the valve body 60 and is sealingly deformed against the exterior surface of the helmet by application of a retaining collar 70 which structurally unifies the valve body 60 with the helmet 10.

Internally the valve body 60 is fashioned with a central bore 72. The bore 72 is threadably fitted at an outlet end thereof with an insert 74. The insert 74 through the provision of a threaded interconnection as at 76 is operably unified with the valve body 60. This insert carries a valve seat 78 which preferably is fashioned in the configuration of a truncated cone.

A valve member 80 is fitted within the cone 72 and engages the interior surface of the bore through conventional threaded surfaces 82.

The valve member 80 includes a valve stem 84 which projects through the valve body 60 and carries a control knob 86. The control knob 86 is mounted upon the valve stem 84 through the provision of a set screw 88 and is peripherally provided as at 90 with heavy diamond knurling such that a diver wearing the helmet may readily grasp the hand knob 86 and rotate the valve stem 84. Rotation of the valve stem 84 will serve through the vehicle of threaded means 82 to advance or retract the valve member 80 with respect to the insert 74.

The valve member 80 is fashioned with a frusto-conical surface 92 which is operably compatible with valve seat surface 78 to form a circular restriction passage 94 between the surfaces 78 and 92. It will be appreciated that through the provision of the flow path restriction between valve seat 78 and surface 92 a diver may accurately regulate the flow of gas from inlet 62 through the valve body 60 into outlet 64.

Safety Valve Structure

Under certain exigencies, a diver may become confused or disoriented and rotate hand knob 86 so as to completely shut off a flow of gas through the valve body 60, note FIG. 3. Once the supply valve 12 is closed down, it is highly unlikely that a diver would have the subsequent presence of mind to counter-rotate the valve in order to increase the supply of breathable gas and oxygen to the helmet 10. A significant aspect of the present invention is directed to eliminating the possibility of a diver completely shutting off his supply of breathable gas, while at the same time minimizing the possibility of losing a gas bubble within the helmet 10 in the event supply line 44 should be accidentally severed.

More particularly and with reference to FIG. 4, the valve member 80 is fashioned with a radial bore 100 which provides fluid communication between the central bore 72 of the valve body 60 and a central portion of the valve member 80.

With renewed attention now to FIGS. 2 and 3, the valve member 80 is also fashioned with an axially extending bore 102 which intersects radial bore 100. The bores through the valve member 80 operably establish a fluid passage from the supply valve inlet 62 to the supply valve outlet 64 through the interior of the valve body 80.

Accordingly, and in the event a diver should inadvertently close down the supply valve in a manner such as depicted in FIG. 3, a supply of breathable gas passes through the interior of the valve member 80 through bores 100 and 102. Thus a minimum subsistence level of breathable gas will be continually delivered into the diver's helmet 10.

The axial bore 102 is fashioned at its outlet end with an enlarged cylindrical threaded opening which is operable to receive a threaded insert 104. The insert in turn is fashioned with a bore 106 thus maintaining fluid communication, through the insert, with the axial bore 102 of the valve member.

A check valve 108 is inserted within the bore 102 and includes a generally cylindrical body portion 110 having a central passage. Body portion 110 is releasably held between an interior ledge 112 fashioned within bore 102 and an internal face 114 of the insert 104. The body member 110 is provided with a pair of "duckbills" or cantilevered upper and lower leaves 116 and 118. These leaves are positioned within the bore 102 to freely open in response to a flow of fluid from right to left as viewed in FIG. 3 but will close to mutually seal against each other in the event of attempted fluid flow from left to right. The normally closed posture of the valve 108 is depicted in FIG. 2.

In sum, once the valve member 80 is advanced from right to left as viewed in FIG. 3, as might be the case of inadvertent closing of the valve by a disoriented diver, the variable path flow restriction 94 will be closed off with the valve face 92 is in sealing engagement against valve seat 78, note FIG. 3.

Notwithstanding, however, closing of supply valve 12, if the integrity of the supply conduit 44 is maintained and pressurized breathable gas is being delivered to the inlet 46 of inlet fitting 62, the gas pressure at the inlet will exceed the gas pressure at the outlet of the supply valve 12 and breathable gas will flow through bores 100 and 102 to open the check valve leaves 116 and 118. Accordingly, breathable gas will pass through the interior of the valve body 80 and into the diver's helmet 10.

In the event that supply line 44 should become accidentally severed thus lowering gas pressure at the inlet 46 of the valve body below gas pressure at the outlet, the check valve leaves 116 and 118 will snap shut and mutually seal against each other in a posture as depicted in FIG. 2. The diver would manually quickly close down the supply valve member so that an outward flow of gas from the helmet to the ambient water would be prevented and a gas bubble within the helmet would be retained to enable the diver to return to chamber 20.

SUMMARY OF MAJOR ADVANTAGES

In describing a supply valve assembly according to the present invention, several advantages have been specifically and inherently disclosed. Nonetheless, a brief summary of advantages at this point may be both useful and appropriate.

A principal advantage of the present invention resides in the provision of a supply valve for delivering breathable gas to a diver wherein a minimum flow of gas through the system will be maintained notwithstanding the fact that a diver may have become disoriented and closed the supply valve.

Another significant advantage is the provision of a secondary valve which will readily permit a flow of breathable gas through the interior of a closed valve member while preventing a counterflow of gas through the interior of a valve member during an exigent circumstance such as in the event a gas supply conduit may have been severed.

A related advantage of the subject invention is the provision of an easily replaceable and maintainable "duckbill" type check valve assembly which is mounted within a bore extending through the valve member. The check valve is operable in combination with the supply valve independent of metallic springs, etc. which may tend to corrode and become nonfunctional.

While the invention has been described with reference to preferred embodiments, it will be appreciated by those skilled in the art that additions, deletions, modifications, and substitutions or other changes not specifically described may be made which will fall within the purview of the claims.

What is claimed is:

1. An underwater breathing system comprising:

diving helmet means;

a valve body carried by said diving helmet means and having primary passage means extending therethrough with an inlet operable to communicate with a diving gas supply conduit and an outlet operable to transmit said diving gas to the interior of said diving helmet means;

a valve seat means connected with said valve body;

a valve member positioned within said passage means; threaded mounting means mounting said valve member for threaded movement toward and away from said valve seat means;

a hand knob connected to said valve member for permitting a submerged diver to threadably manipulate said valve member in said threaded mounting means so as to control the position of said valve member and thus selectively regulate a flow of gas through said passage means of said valve body passing to said interior of said diving helmet means;

secondary passage means extending through said valve member, with first and second ends of said secondary passage means being in fluid communication with said inlet and said outlet, respectively, of said primary passage means of said valve body;

said secondary passage means being operable to permit only a unidirectional flow of gas through said valve member from said inlet of said outlet of said valve body when said valve member is seated on said valve seat means;

said secondary passage means including check valve means and having a sufficient flow capacity so as to be operable to transmit a unidirectional flow of gas to said diving helmet means sufficient to maintain at least a minimum subsistence supply of gas therewithin;

said check valve means being operable to permit said unidirectional control, and prevent an outward flow of gas from said diving helmet means through said secondary passage means when said diving gas supply conduit is severed.

2. An underwater breathing system as described in claim 1 wherein:

said check valve means is removably mounted in said secondary passage means; and said system includes check valve restraining and access means disposed in said valve member and accessible from said valve body outlet to permit removal of said check valve means from said valve member while said valve member remains mounted in said threaded mounting means.

* * * * *